United States Patent [19]

Ghisalberti

[11] Patent Number: 4,461,208

[45] Date of Patent: Jul. 24, 1984

[54] WETTING DEVICE AND METHOD IN OFFSET PRINTING

[76] Inventor: Luigi Ghisalberti, Via Abruzzi, 3, 24035 Curno (Bergamo), Italy

[21] Appl. No.: 367,328

[22] Filed: Apr. 12, 1982

[30] Foreign Application Priority Data

Dec. 15, 1981 [IT] Italy ..... 2936 A/81

[51] Int. Cl.[3] ..... B41F 7/26; B41F 7/36; B41F 7/32

[52] U.S. Cl. ..... 101/148; 101/350

[58] Field of Search ..... 101/148, 147, 350, 349, 101/363, 207, 208-210

[56] References Cited

U.S. PATENT DOCUMENTS

| | | | |
|---|---|---|---|
| 3,146,706 | 9/1964 | Tonkin et al. | 101/148 |
| 3,259,082 | 6/1966 | Dahlgren | 101/148 X |
| 3,431,842 | 3/1969 | Winkler et al. | 101/148 X |
| 3,433,155 | 3/1969 | Norton | 101/148 |
| 3,552,311 | 1/1971 | Petri | 101/148 |
| 3,587,460 | 6/1971 | Chambon | 101/148 |
| 3,673,959 | 7/1972 | Jezuit et al. | 101/425 X |
| 3,805,700 | 4/1974 | Chambon | 101/148 |
| 3,911,815 | 10/1975 | Banfer | 101/350 |
| 4,044,674 | 8/1977 | Smith, Jr. | 101/148 |
| 4,351,236 | 9/1982 | Beisel | 101/352 |

FOREIGN PATENT DOCUMENTS

| | | | |
|---|---|---|---|
| 2440757 | 4/1975 | Fed. Rep. of Germany | 101/148 |

*Primary Examiner*—J. Reed Fisher

[57] ABSTRACT

Wetting device and method with water-alcohol mixture in offset printing, wherein three rollers 4,5,6 are provided as associated with the plate holder cylinder 1, the inking roller unit and the vibrating unit 2, of which the solution is supplied on the first resilient roller 4, the second of which 5 is a hydrophile chromium plated roller acting as a transfer roller and the third of which 6, similarly resilient and separable from the first other two rollers 4,5 performs the function of solution metering roller directly on at least one vibrating roller 7, as well as on the vibrating battery 2, the solution being then transferred to the plate on the cylinder 1.

3 Claims, 4 Drawing Figures

WETTING DEVICE AND METHOD IN OFFSET PRINTING

This invention relates to a continuous wetting device and method of water-alcohol admixture for use in offset printing, wherein according to the invention the matrix wetting step is eliminated and colour emulsion is supplied to the vibrating battery.

As well known in offset printing, one of the most up-to-date wetting methods is continuous or alcohol wetting, which lowers the water surface tension, so that each drop by flattening out will require a less amount of water to provide the correct balance between water and ink. Therefore, it is a basic requirement of this type of wetting to maintain a stable and constant balance between water and ink.

The water-alcohol wetting system presently known, while having some slight difference from one another as to mechanical arrangement and scheme of the wetting rollers, are all characterized by transfering the water-alcohol mixture to the plate or matrix, with the disadvantage of providing an emulsion which is not sufficiently stable for the wetting liquid with the colour.

In a simple and economical manner, this invention is directed by a device of safe operating reliability and easy and short maintenance requirement, to remove the above mentioned disadvantage, by resorting to colour emulsion on the vibrating battery without any wetting step directly on the matrix or plate.

According to the invention, this is accomplished substantially in that three rollers are provided, as associated with the plate holder cylinder, the inking roller unit and the vibrating unit, of which the first of said rollers, which is of resilent nature, is effective for first solution supply, the second is a hydrophile chromium plated roller, at the same time acting as further supply roller and transfer roller, and the third roller, which is resilient and separable from said other two rollers, performs the function of solution metering roller directly on at least one vibrating roller as well as on the vibrating battery, the solution being then transferred to the plate on the plate holder cylinder.

Such a wetting method, due to not operating directly on the plate, avoids the latter from being subjected to various stresses, and solves the problem of cleaning the rollers from impurities (the wetting solution is effective not only as humidifier, but also as a solvent).

Another advantage is that the alcohol, by rapidly evaporating from the plate surface, will carry along some amount of water and leave only a thin film which improves the printing quality, while reducing the ink consumption.

As further advantages, it may be stated that the alcohol, by reducing the water surface tension, avoids the formation of oily films on the plate; it also allows a faster start, less waste and more brilliant colours.

Figure 1:
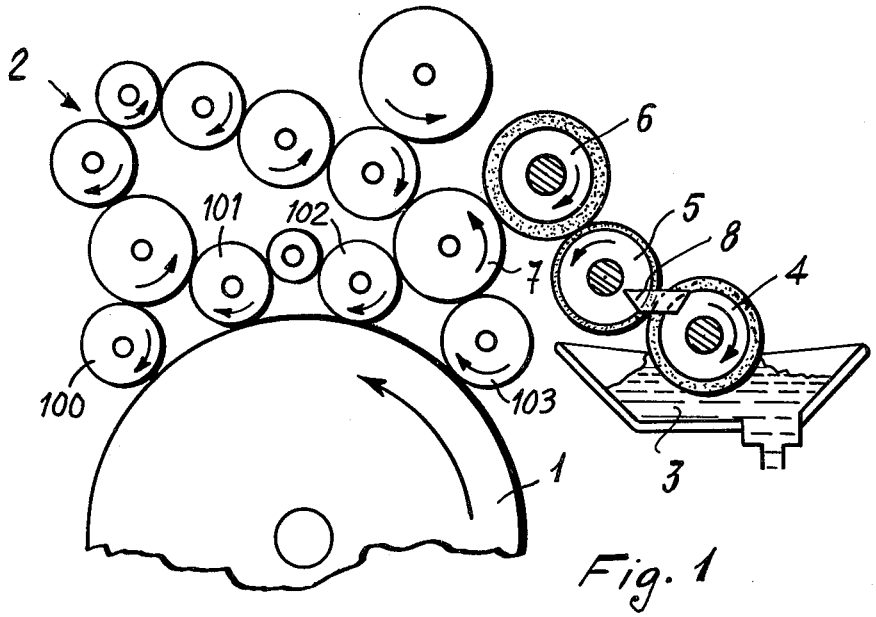
Figure 2:
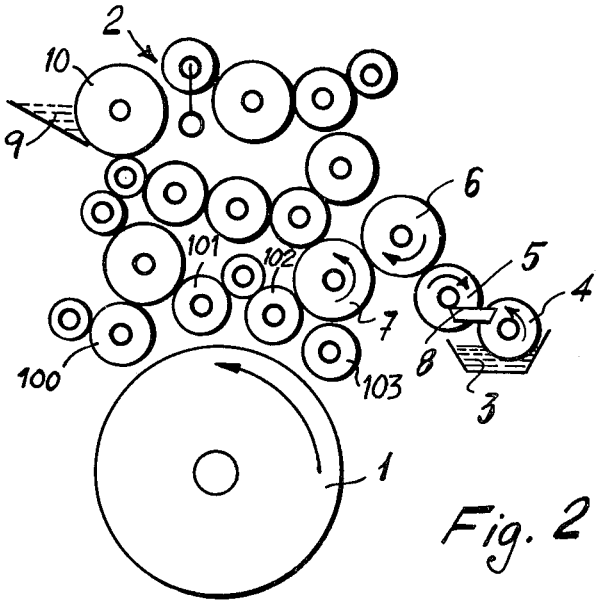
Figure 3:
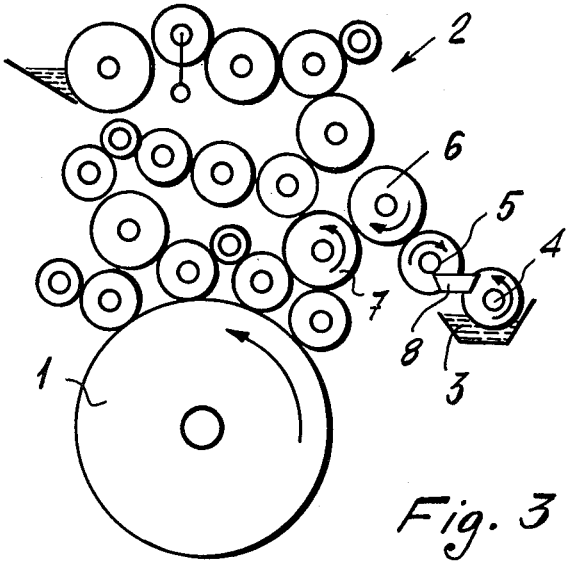
Figure 4:
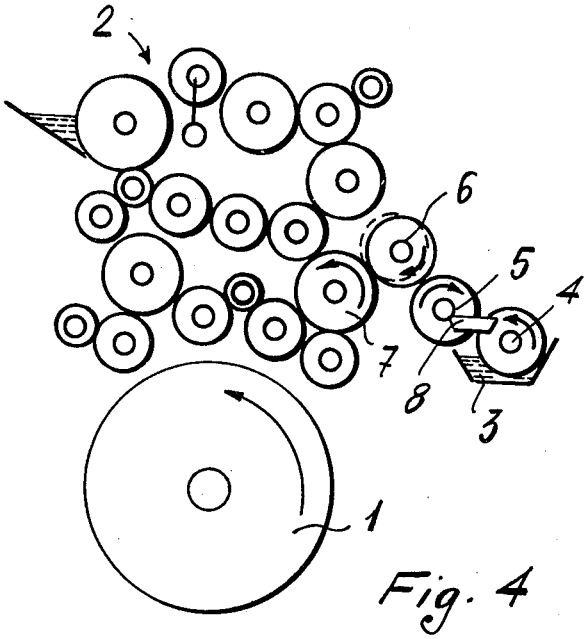

The invention will now be more clearly described in an unrestrictive exemplary embodiment thereof, to be considered in connection with the accompanying drawings, in which:

FIG. 1 is a diagrammatic general view of a plate holder roller with associated inking rollers and vibrating unit in combination with the novel rollers according to the invention; and FIGS. 2, 3 and 4 serve, as the disclosure proceeds, to make clear the three basic operating steps of the method and device according to the invention.

Referring now to the drawings as a whole, reference numeral 1 designates a conventional plate holder cylinder, and general reference numeral 2 designates a conventional and per se known assembly of inking rollers and vibrating battery, which are typical in offset printing. Assembly 2 includes rollers 100, 101, 102 and 103 all of which are shown in contact with cylinder 1.

Reference numerals 4, 5 and 6 respectively designated the three basic rollers according to the invention and which will be further described in the following description.

Reference numeral 7 designates a vibrating roller of the vibrating battery 2, which roller 7 is in contact with roller 6, the latter acting as a distributing or dispensing roller. Reference numeral 3 designates a draft or drawing basin for the supply roller 4. In the drawing, such a basin is located at the bottom, but it is apparent that supply could also occur from the top, according to per se known systems, which are not in the range of the present invention. Similarly, reference numeral 8 designates a possible basin between said roller 4 and roller 5, which may be used to collect dripping liquid.

The various processes for the machine connection and disconnection will be automatic using known electronic devices, and which do not pertain to the present invention.

Passing now to the description of the inventive method, the completely automatic operations according to the invention are as follows.

(1) Preliminary wetting operation of the vibrating rollers is shown in FIG. 2. The wetting solution is directly supplied either to roller 4 or between rollers 4 and 5, said roller 4 making up the first supply roller and being resilient, while said roller 5, also acting as a transfer roller, is a hydrophile chromium plated roller. At this step, the water-alcohol solution is metered in a thin uniform film which partly remains on the supply roller 4 and is collected in the basin, while is partly supplied on the surface of the transfer roller 5 at the contact location with the metering roller 6.

Thus, a film remains on the transfer roller 5 and returns to the first contact location; the remainder, by passing on the metering roller 6 comes in contact with the first vibrating roller 7 and then with the entire vibrating battery 2. At this time, the printing rollers 100–103 are spaced from cylinder 1, permitting the wetting solution to thoroughly mill and stabilize with the pigment 9 delivered by roller 10 to the vibrating battery 2.

(2) The inking rollers 100–103 come in contact with the plate on cylinder 1 as shown in FIG. 3, bringing to the latter the now stable water-alcohol-ink solution.

(3) During a rest step and as depicted in FIG. 4, the inking rollers 100–103 come off from the plate on cylinder 1 and the metering roller 6 comes off from the transfer-supply roller 5.

As above mentioned, supply could occur either by drawing or draft in a basin 3 at the bottom, or by drop from the top in a basin 8, these expedients being in the reach of anyone skilled in the art. The basic concept of the invention is the provision of three rollers, of which the intermediate roller acts both as supply and transfer roller, and last acts as a metering roller for the wetting mixture to a first vibrating roller 7 and accordingly to the entire vibrating battery 2, the wetting operation on the plate occurring only at a successive step and not directly.

Therefore, it will clearly appear that the invention is not limited to the merely indicative details herein shown and/or described, but also comprises all of those variations or equivalent embodiments carried out on the basis of the present inventive concept.

What I claim is:

1. A wetting method for applying a water-alcohol-ink mixture to a printing plate in offset printing, the method comprising: a first preliminary wetting step in which an alcohol-water solution is directly supplied to a supply roller and a transfer roller, the transfer roller being in contact with a further resilient and separable roller performing the function of a metering roller, said metering roller being at that time in contact with a first vibrating roller of a vibrating battery, whereby the solution is transferred to the vibrating battery, and at the same time a pigment is applied to said vibrating battery, whereby the pigment and solution are mixed by the vibrating battery; a second step in which inking rollers, which are in contact with the vibrating battery, are brought into contact with the plate, thereby delivering the water-alcohol-ink mixture to the plate; and a third step in which the inking rollers are moved away from the plate and the metering roller is moved away from the transfer roller.

2. A method according to claim 1, wherein the wetting operation for the supply roller is carried out by drawing in an underlying basin.

3. A method according to claim 1, wherein the preliminary wetting operation occurs by supplying the solution from the top between said supply roller and transfer roller.

* * * * *